US009492053B2

(12) United States Patent
Shin et al.

(10) Patent No.: US 9,492,053 B2
(45) Date of Patent: Nov. 15, 2016

(54) DISH WASHER AND AIR BREAK THEREOF

(75) Inventors: Yongho Shin, Seoul (KR); Byoungsoo Je, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 1056 days.

(21) Appl. No.: 13/564,795

(22) Filed: Aug. 2, 2012

(65) Prior Publication Data

US 2013/0032181 A1 Feb. 7, 2013

(30) Foreign Application Priority Data

Aug. 3, 2011 (KR) ..... 10-2011-0077171

(51) Int. Cl.
*A47L 15/42* (2006.01)

(52) U.S. Cl.
CPC ..... *A47L 15/4217* (2013.01)

(58) Field of Classification Search
CPC ..... A47L 15/42
USPC ..... 134/184
See application file for complete search history.

(56) References Cited

U.S. PATENT DOCUMENTS 7,434,587 B2 * 10/2008 Jeong ..... A47L 15/4223 134/58 D
2007/0131261 A1 * 6/2007 Lee ..... A47L 15/4217 134/112
2008/0072930 A1 * 3/2008 Pyo ..... A47L 15/0049 134/25.2

FOREIGN PATENT DOCUMENTS

| | | |
|---|---|---|
| EP | 0 864 290 | 9/1998 |
| EP | 0 876 789 | 10/2003 |
| KR | 10-2007-0105046 | 10/2007 |
| KR | 10-1054104 | 8/2011 |

OTHER PUBLICATIONS

Korean Notice of Allowance dated Jan. 14, 2013.

* cited by examiner

*Primary Examiner* — Michael Barr
*Assistant Examiner* — Rita Adhlakha
(74) *Attorney, Agent, or Firm* — Ked & Associtess LLP

(57) ABSTRACT

A dish washer is provided. The dishwasher includes a washing tub formed with a washing space, an air break provided at one side of the washing tub and that guides a flow of washing water, and a sump that supplies the washing water to the washing tub. The air break includes a water supply passage, through which water supplied from outside flows, a water chamber that stores the water that flows through the water supply passage, an air passage that receives air from the outside therethrough, and a flow adjusting member that flows the air of the air passage into the water chamber.

20 Claims, 4 Drawing Sheets

DISH WASHER AND AIR BREAK THEREOF

CROSS-REFERENCE TO RELATED APPLICATION

The present application claims priority under 35 U.S.C. 119 and 35 U.S.C. 365 to Korean Patent Application No. 10-2011-0077171 (filed on Aug. 3, 2011), which is hereby incorporated by reference in its entirety.

BACKGROUND

The present disclosure related to a dish washer and air break thereof.

In general, the dish washer includes a dish rack receiving the dish at the inside of a tub, an injection nozzle injecting washing water into the dish received by the dish rack, a sump supplying the washing water to the injection nozzle, an air break supplying the washing water to the sump, and a washing pump pumping the washing water of the sump.

The dish washer allows the washing water stored in the sump to be injected into the injection nozzle by driving the washing pump. Further, the washing water injected from the injection nozzle is ejected by high pressure, thereby to be bump into the surface of the dish received at the dish rack. Therefore, dirt is washed out of the surface of the dish by the water pressure of the washing water bumped into the surface of the dish.

Further, a dish washing process includes a washing process washing the dirt out of the dish, a rinsing process rinsing the dish after finishing the washing process, and a drying process removing water out of the surface of the dish after finishing the rising process.

SUMMARY

Embodiments provide a dish washer and air break thereof.

In one embodiment, a dish washer comprises a washing tub formed with a washing space; an air break disposed in one side of the washing tub and guiding flow of washing water; and a sump supplying the washing water to the washing tub, wherein the air break includes a water supply passage flowing water supplied from the outside, a water chamber storing the water flown through the water supply passage, an air passage flowing the air in the outside of the washing tub, and a flow adjusting member flowing the air of the air passage into the water chamber.

In another embodiment, an air break of a dish washer comprises a water inflow portion inflowing water; a water supply passage flowing the water flown through the water inflow portion; a water chamber storing the water flown through the water supply passage; an air inflow hole inflowing air; an air passage flowing the air flown through the air inflow hole; a communication hole communicated with the air passage and communicating with a washing tub; a partition wall partitioning the water supply passage and the air passage; an opening formed in the partition wall; and a flow adjusting member allowing the air in the air passage to be flown to the water chamber through the opening and allowing the water in the water chamber to be not discharged into the air passage.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense.

Figure 1:
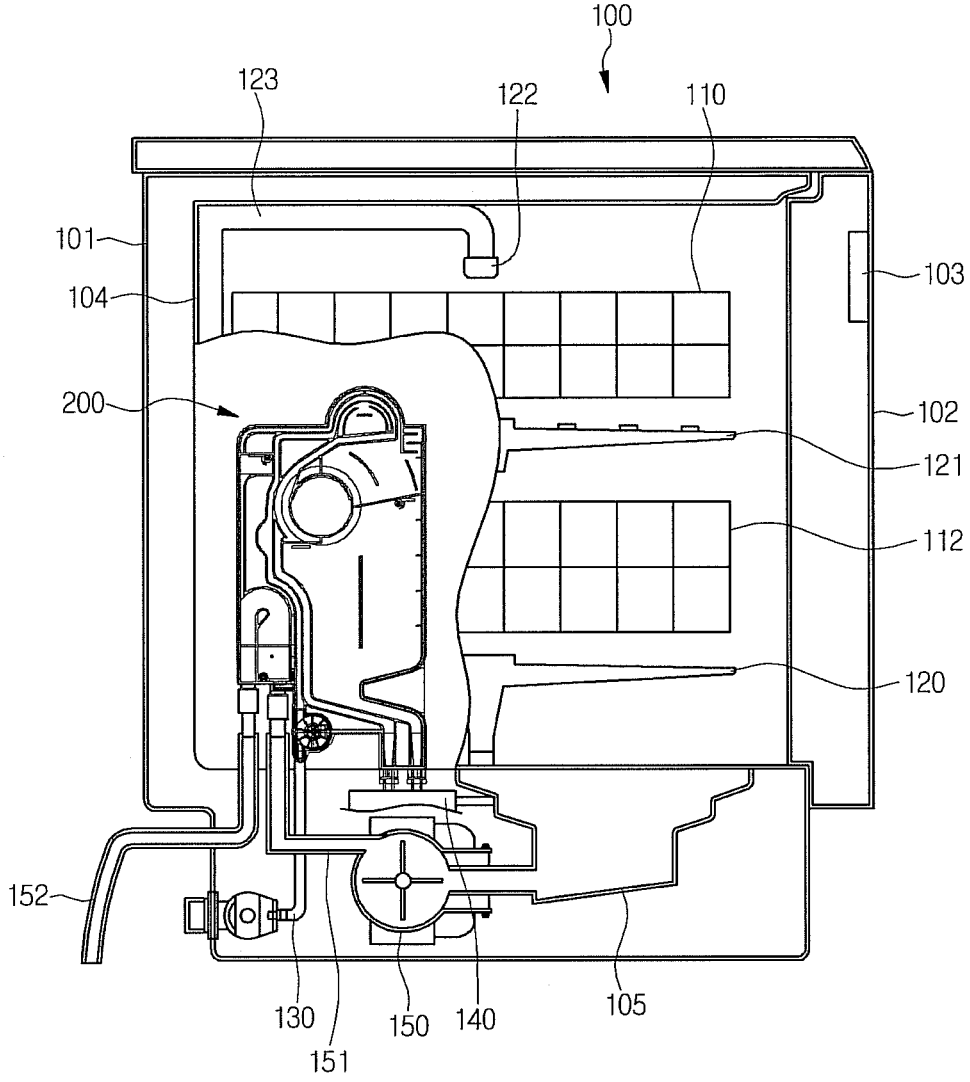
FIG. 1 is a sectional view for schematically showing a dish washer according to an embodiment.
Figure 2:
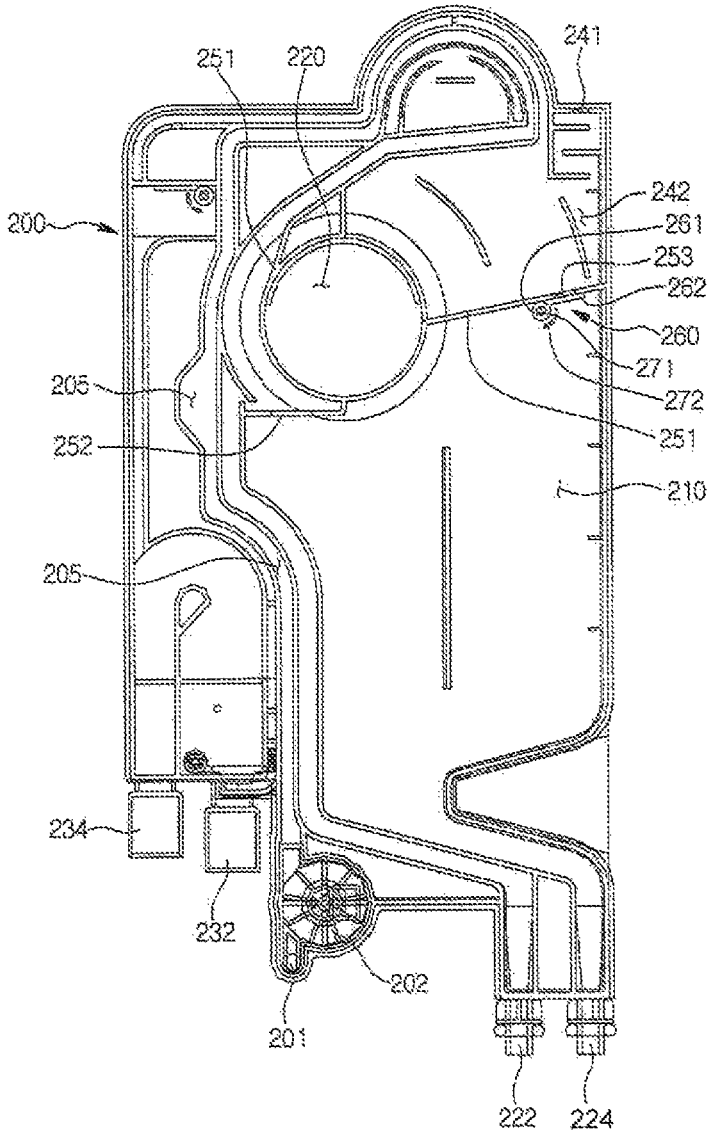
FIG. 2 is a sectional view for showing an air break according to an embodiment.
Figure 3:
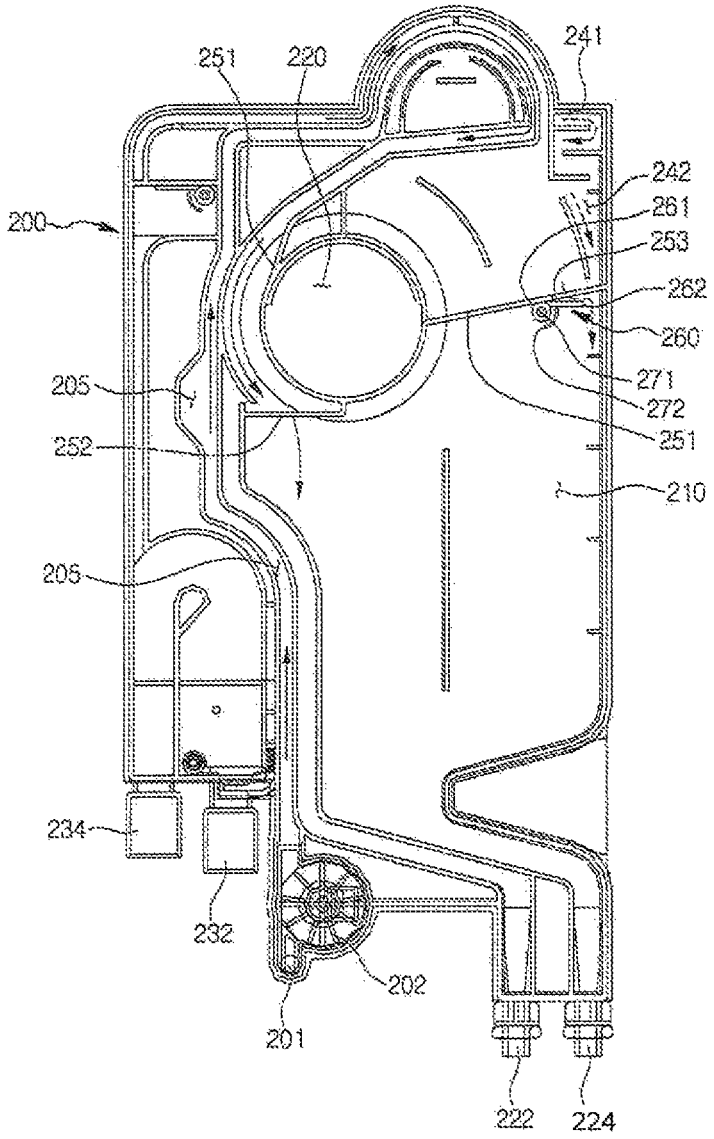
FIG. 3 is a view for showing flow of water and air in the air break.

FIG. 1 is a sectional view for schematically showing a dish washer according to an embodiment, FIG. 2 is a sectional view for showing an air break according to an embodiment, and FIG. 3 is a view for showing flow of water and air in the air break.

Referring to FIGS. 1 and 2, the dish washer 100 of the present embodiment includes a case 101 forming an appearance, a washing tub 104 disposed in the case 101 and forming a washing space washing a dish, a sump 105 disposed in one side of the washing tub 104 and collecting washing water washing the dish, and a door 102 opening/closing the washing tub 104.

A front top of the door 102 may be disposed with a control panel 103 controlling the dish washer. An inside space of the washing tub 104 may be disposed with a plurality of racks laid with the dish. The plurality of racks include an upper rack 110, and a lower rack 112 positioned in a bottom of the upper rack 110. For example, two racks 110 and 112 are disposed in the washing tub 104 in the present embodiment, but the number of the racks is not limited thereto.

Further, the inside of the washing tub 104 is disposed with a plurality of washing nozzles receiving the washing water from the sump 105 and injecting the washing water into the dish laid in the racks 110 and 112.

The plurality of washing nozzles may include a lower nozzle 120 connected to a top of the sump 105, a medium nozzle 121 positioned above the lower nozzle 120 and receiving the washing water from the sump 105, and a top nozzle 122 positioned above the medium nozzle 121 and receiving the washing water from the sump 105, but the number and positions of the plurality of washing nozzles are not limited in the present invention.

The sump 105 is connected with the washing water guide 123 transferring the washing water to the medium nozzle 121 and top nozzle 122. The washing water guide 123 may be formed with a single washing water passage or two washing water passages to be partitioned. On the other hand, the washing water may be transferred to each of the medium nozzle 121 and top nozzle 122 by each of the plurality of washing water guides.

The dish washer 100 further includes an air break 200 disposed between the washing tub 104 and the case 101, guiding the flow of the washing water, and allowing outside air of the washing tub 104 to be communicated with inside air of the washing tub 104.

The air break 200 includes a water inflow portion 201 connected with a water supply tube 130 connected to an outside water supply source (not shown), a flow meter 202 sensing the amount of water flown into the water inflow portion 201, a water supply passage 205 flowing the water flown to the water inflow portion 201, and a water chamber 210 collecting the water flown through the water supply passage 205.

The water supply passage 205 may be bent repeatedly, and a part of the water supply passage 205 is extended from a bottom of the air break 200 to the top thereof. Further, the water supply passage 205 may be bent at the top of the air break 200 and extended to the bottom.

The air break 200 includes an air inflow hole 241 inflowing outside air (air outside the washing tub), an air passage 242 flowing the air flown through the air inflow hole 241, and a communication hole 220 communicating the inside of the air break 200 with the washing tub 104.

The air passage 242 is repeatedly bent to prevent the water in the air break 200 from flowing into the air inflow hole 241. In addition, the air passage 242 is communicated with the communication hole 220.

The water supply passage 205 and the communication hole 220 in the air break 200 are partitioned by a partition wall 251. Further, the water supply passage 205 and the air passage 242 are also partitioned by the partition wall 251. Further, the water chamber 210 and the air passage 242 may be also partitioned by the partition wall 251.

Further, the partition wall 251 forms parts of the water supply passage 205 and the water chamber 210. In addition, the partition wall 251 forms part of the air passage 242.

The partition wall 251 is formed with a water passing hole 252 flowing the water of the water supply passage 205 into the water chamber 210.

Further, the partition wall 251 is formed with an opening 253 flowing the air flown through the air inflow hole 241 into the water chamber 210. In addition, the opening 253 may be opened/closed by an opening/closing member 260. The opening/closing member 260, for example, may be disposed in the water chamber 210. The opening/closing member 260 may include a rotation axis 261 coupled with the water chamber 210, and an opening/closing plate 262 extended from the rotation axis 261 and opening/closing the opening 253. Further, the opening/closing member 260 may include the opening/closing plate 262 connected to the rotation axis formed in the water chamber 210.

In addition, the wall forming the water chamber 210 includes an axis supporting portion 271 supporting the rotation axis 261, and a plate supporting portion 272 supporting the opening/closing plate 262 when the opening 253 is opened by the opening/closing plate 262.

The opening/closing member 260 may be formed by an elastic material, for example, rubber material. In this case, the opening 253 may be opened by the opening/closing plate 262 due to air pressure, and closed by the opening/closing plate 262 due to the elastic force itself of the opening/closing plate 262 on removing the air pressure.

At this time, when the water increases to the opening/closing plate 262 due to reverse water pressure in the water chamber 210, the water lifts the opening/closing plate 262 stably closing the opening 253, and it may be prevented that the water in the water chamber 210 is discharged into the air passage 242 through the opening 253.

As another example, the opening/closing member 260 may be formed by, for example, plastic material. In this case, a torsion spring not shown may be connected to the rotation axis 261. Therefore, when an external force is not applied to the opening/closing plate 262, the opening/closing plate 262 closes the opening 253. At this time, when the air pressure is applied to the opening/closing plate 262, the opening/closing plate 262 opens the opening 253.

Referring to FIG. 3, the water (displayed by solid lines in FIG. 3) flown through the water supply passage 205 during a water supply process is flown into the water chamber 210 through the water passing hole 252. The air (displayed by dotted lines in FIG. 3) flown through the air inflow hole 241 flows through the air passage 242, and then, is flown into the water chamber 210 through the opening 253.

Therefore, since the air is supplied to the water chamber 210 without directly supplying to the water supply passage 205, water supply noise caused by air drops in the water supply passage 205 is not generated and simultaneously, a siphon phenomenon that continually inflows raw water, even when stopping the water supply, is not generated.

On the one hand, the air break may further include a first connection 224 connected to a water softener 140 removing hardness components contained in the water, and a second connection 222 connected to a regenerator (not shown).

In addition, the air break 200 may further include a first drainage connection 232 connected by a first drainage passage 151 to a drainage pump 150 connected to the sump 105, and a second drainage connection 234 connected with a second drainage passage 152.

In the present embodiment, the opening/closing member 260 called a flow adjusting member allows the air in the air passage 242 to be flown to the water chamber 210 and allows the water to be not discharged into the air passage 242 from the water chamber 210.

Figure 4:
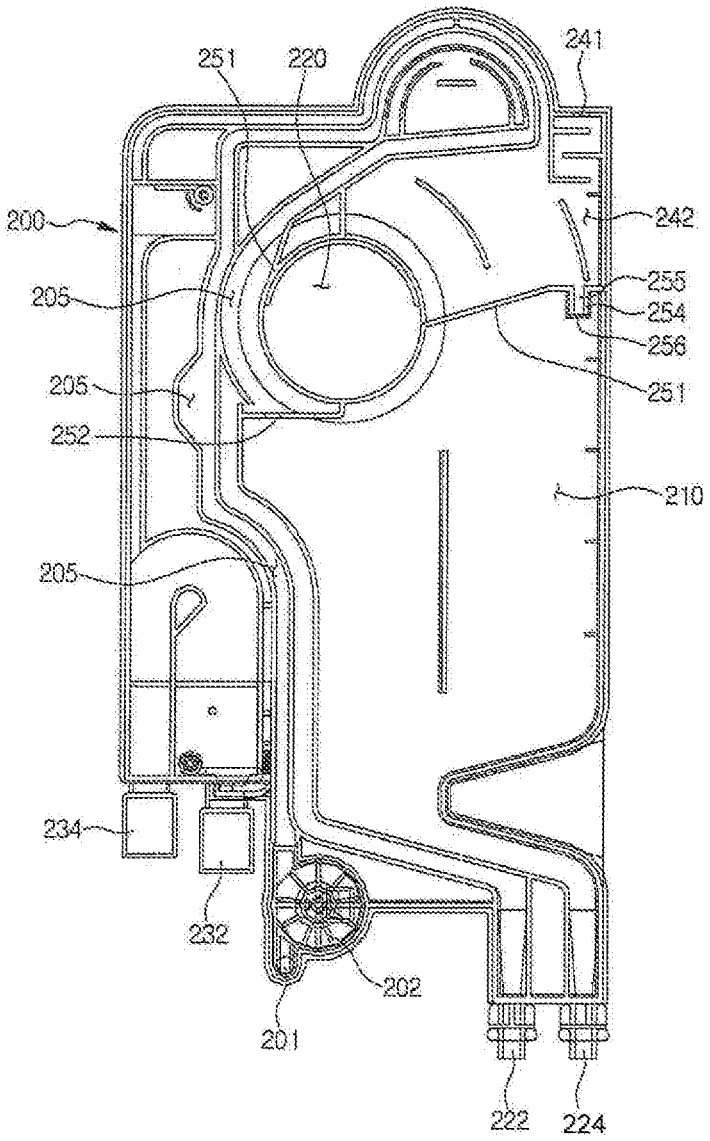
FIG. 4 is a sectional view for showing the air break according to another embodiment.

FIG. 4 is a sectional view for showing the air break according to another embodiment.

An element of the opening/closing member in the present embodiment is different from the previous embodiment, but the other section of the present embodiment is the same as the previous embodiment. Therefore, hereinafter, the characteristic section only in the present invention will be described.

Referring to FIG. 4, the partition wall 251 of the air break in the present invention is formed with a flow tube 254 flowing the air. The flow tube 254 is extended to the water chamber 210 from the partition wall 251. As another example, the flow tube 254 may be extended from the partition wall 251 to the air passage 242.

The flow tube 254 is formed with the opening 255 flowing the air.

Further, the flow tube 254 is surrounded by the flow adjusting member 256. That is, the flow adjusting member covers the opening 255. The flow adjusting member 256 includes a plurality of air holes. At this time, the air hole of the flow adjusting member 256 may flow the air, but are formed in a size that does not flow the water.

As other example, the inside of the flow tube 254 may be inserted with the flow adjusting member. Even in this case, the air may be flown into the water chamber 210 through the flow adjusting member, but the water does not pass through the flow adjusting member.

As further another example, the partition wall 251 is formed with the opening, and it is possible to cover the opening by the flow adjusting member.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A dish washer, comprising:

a washing tub formed with a washing space;

an air break disposed at one side of the washing tub, which guides a flow of washing water; and a sump that supplies the washing water to the washing tub, wherein the air break includes:

a water supply passage through which water supplied from outside of the washing tub flows;

a water chamber to store the water flowing through the water supply passage;

an air inflow hole, through which air flows in from outside of the washing tub;

an air passage through which the air that flows in through the air inflow hole flows;

a partition wall that partitions the air passage and the water chamber;

an opening formed in the partition wall, through which the air that flows in through the air inflow hole flows into the water chamber; and a flow adjuster that allows the air in the air passage to flow into the water chamber through the opening and prevents the water in the water chamber from being discharged into the air passage.

2. The dish washer according to claim 1, wherein the partition wall partitions the water supply passage and the air passage.

3. The dish washer according to claim 1, wherein the flow adjuster is an opening/closing member that opens and closes the opening.

4. The dish washer according to claim 3, wherein the flow adjuster is positioned within the water chamber.

5. The dish washer according to claim 3, wherein the opening/closing member includes an opening/closing plate that opens and closes the opening by a rotation movement.

6. The dish washer according to claim 5, wherein the opening/closing member includes a rotational axis that provides a rotational center of the opening/closing plate, and wherein a wall that forms the water chamber includes an axis support that supports the rotational axis.

7. The dish washer according to claim 5, wherein the opening/closing plate is made of a rubber material, wherein the opening/closing plate is elastically deformed by air pressure to open the opening, and wherein, on removing the air pressure, the opening/closing plate returns to its original form and closes the opening.

8. The dish washer according to claim 5, wherein the opening/closing plate further includes an elastic member that provides an elastic force in a direction to close the opening.

9. The dish washer according to claim 5, wherein a wall that forms the water chamber includes a plate support that supports the opening/closing plate when the opening is opened by the opening/closing plate.

10. The dish washer according to claim 1, wherein the flow adjuster that covers the opening includes a plurality of air holes.

11. The dish washer according to claim 1, wherein the partition wall includes a flow tube through which the air flows, wherein the flow tube includes the opening, and wherein the flow adjuster surrounds the flow tube.

12. The dish washer according to claim 1, wherein the partition wall includes a flow tube through which the air flow, wherein the flow tube includes the opening, and wherein the flow adjuster is inserted into the opening.

13. The dish washer according to claim 1, wherein the air break further includes a communication hole that communicates with the air passage and the washing tub.

14. The dish washer according to claim 13, wherein the partition wall partitions the water supply passage and the communication hole.

15. The dish washer according to claim 1, wherein the air break further includes a water inflow portion connected with a water supply tube through which the water is supplied to the water supply passage from the outside.

16. The dish washer according to claim 15, wherein the air break further includes a flow meter that senses an amount of the water flowing into the water inflow portion.

17. The dish washer according to claim 1, wherein the partition wall forms a portion of the water supply passage and a portion of the water chamber.

18. The dish washer according to claim 17, wherein a water passing hole is formed in the partition wall through which the water from the water supply passage flows into the water chamber.

19. The dish washer according to claim 1, wherein the air break further includes a first connection connected to a water softener and a second connection connected to a regenerator.

20. The dish washer according to claim 1, wherein the air break further includes a first drainage connection connected to a drainage pump by a first drainage passage and a second drainage connection connected to a second drainage passage, and wherein the drainage pump is connected to the sump.

* * * * *